US006282856B1

(12) United States Patent
MacKarvich

(10) Patent No.: US 6,282,856 B1
(45) Date of Patent: Sep. 4, 2001

(54) STABILIZATION PAD PROVIDING LATERAL AND LONGITUDINAL SUPPORT SYSTEM FOR PREMANUFACTURED BUILDING

(76) Inventor: Charles J. MacKarvich, 1720 Tyler Green Trail, Smyrna, GA (US) 30080

( * ) Notice: Subject to any disclaimer, the term of this patent is extended or adjusted under 35 U.S.C. 154(b) by 0 days.

(21) Appl. No.: 09/296,992

(22) Filed: Apr. 22, 1999

Related U.S. Application Data

(63) Continuation-in-part of application No. 09/123,806, filed on Jul. 27, 1998, now Pat. No. 6,058,663, which is a continuation-in-part of application No. 08/739,717, filed on Oct. 29, 1996, now Pat. No. 5,850,718, which is a continuation-in-part of application No. 08/644,069, filed on May 9, 1996, now Pat. No. 5,784,844, which is a continuation-in-part of application No. 08/629,834, filed on Apr. 10, 1996, now Pat. No. 5,697,191.

(51) Int. Cl.[7] ..... E02D 27/42

(52) U.S. Cl. ..... 52/299; 52/294; 52/126.6; 52/DIG. 11; 248/188.1; 248/499; 248/500; 248/680; 248/681

(58) Field of Search ..... 52/294, 295, 169.9, 52/299, 126.6, DIG. 11; 248/188.1, 499, 500, 680, 681

(56) References Cited

U.S. PATENT DOCUMENTS

| | | | | |
|---|---|---|---|---|
| 3,750,349 | | 8/1973 | Deike | 52/23 |
| 3,802,138 | | 4/1974 | McCarter | 52/148 |
| 3,830,024 | | 8/1974 | Warnke | 52/23 |
| 3,845,597 | | 11/1974 | Foster | 52/166 |
| 4,261,149 | | 4/1981 | Gustafson | 52/292 |
| 4,417,426 | * | 11/1983 | Meng | 52/126.7 |
| 5,359,821 | | 11/1994 | Merriman | 52/169.9 |
| 5,697,191 | | 12/1997 | MacKarvich | 52/169.9 |
| 5,758,460 | | 6/1998 | MacKarvich | 52/292 |
| 5,784,844 | | 7/1998 | MacKarvich | 52/292 |
| 5,850,718 | * | 12/1998 | MacKarvich | 52/292 |

OTHER PUBLICATIONS

Manufactured Housing Anchoring Installation Information, Tie Down Engineering Brochure, 4 pages.

Manufactured Housing Institute Memorandum dated Jan. 10, 1995, 1 page.

NISTIR 5664 Recommended Performance–Based Criteris for the Design of Manufactured Home Foundation Systems to Resist Wind and Seismic Loads, 56 pages.

* cited by examiner

*Primary Examiner*—Carl D. Friedman
*Assistant Examiner*—Christy M. Syres
(74) *Attorney, Agent, or Firm*—Thomas, Kayden, Horstemeyer & Risley

(57) ABSTRACT

The present invention provides an apparatus and method for supporting a manufactured home (1) having at least a first and second support joist (14*a*, 14*b*) for mounting horizontally on at least a first and second vertical support structure (9*a*, 9*b*). Each vertical support structure (9*a*, 9*b*) comprises an upright support pier (16*a*, 16*b*) with a support platform (12*a*, 12*b*) positioned beneath the support pier (16*a*, 16*b*) and adjacent the ground (13). A stabilization pad (30*a*, 30*b*) is positioned between the support pier (16*a*, 16*b*) and the support platform (12*a*, 12*b*). The stabilization pad (30*a*, 30*b*) can include a link (60*a*) and a clamping lip (36) from which a lateral compression member (20) can extend as positioned between the pair of stabilization pads (30*a*, 30*b*). Further included is at least one tie strap (18*a*, 18*b*) extending upwardly from the link (60*a*), over the support joist (14*a*, 14*b*) and continuing downwardly from the support joist (14*a*, 14*b*) to a member such that tension is provided in the tie strap (18*a*, 18*b*), and a longitudinal strut (60*a*) extending upwardly from the vertical support structure (9*a*, 9*b*) to the support joist (14*a*, 14*b*) supported by that vertical support structure (9*a*, 9*b*).

20 Claims, 3 Drawing Sheets

STABILIZATION PAD PROVIDING LATERAL AND LONGITUDINAL SUPPORT SYSTEM FOR PREMANUFACTURED BUILDING

CROSS REFERENCE

This application is a continuation-in-part of U.S. patent application Ser. No. 09/123,806 filed Jul. 27, 1998, now U.S. Pat. No. 6,058,663 issued May 9, 2000; which is a continuation-in-part of U.S. patent application Ser. No. 08/739,717 filed Oct. 29, 1996, now U.S. Pat. No. 5,850,718 issued Dec. 22, 1998; which is a continuation-in-part of U.S. patent application Ser. No. 08/644,069 filed May 9, 1996, now U.S. Pat. No. 5,784,844 issued Jul. 28, 1998; which is a continuation-in-part of U.S. patent application Ser. No. 08/629,834 filed Apr. 10, 1996, now U.S. Pat. No. 5,697,191 issued Dec. 16, 1997.

FIELD OF THE INVENTION

The present invention generally relates to a stabilizing system for a premanufactured building having support joists extending along the length of the underside of the building and being supported by upright piers. More specifically, the present invention relates to stabilization pads positioned beneath the upright piers having the capability to provide motion resistance to to lateral and longitudinal winds where both portions of the system are attached to a stabilization pad.

DISCUSSION OF RELATED ART

Premanufactured buildings, such as mobile homes, trailers, prefabricated houses, and the like are manufactured at a central manufacturing site, and upon completion the buildings are moved to a location where they are to be permanently located and occupied. Because these buildings are designed to be easily moved from the manufacturing site to the permanent location, they are not originally built on a permanent foundation at the manufacturing site, but on a pair of parallel I-beam joists, and then the manufactured building is transported to and mounted upon piers, such as concrete blocks, pilings or stabilizing jacks, at a site where the building will be used. It is important that the building also be anchored in position on the piers, so as to avoid the building being shifted off of its piers by strong winds or earth tremors. A building inadvertently shifted off of its piers can cause serious damage to the building and also can cause human injury.

Various types of stabilizing devices have been used to stabilize the manufactured buildings, to keep the buildings from moving in response to wind forces and earth movement, such as guy wires, straps or other ties which connect the building to anchors or ground futures. A traditional approach to providing lateral wind protection for manufactured buildings consists of an anchor having a shaft with one or more helical plates at the bottom of the shaft which can be rotated to move into the earth, and cold-rolled steel strapping installed as diagonal ties between the upper exposed portion of the anchor and the lower main frame of the manufactured building. A system of this type is taught in U.S. Pat. No. 3,747,288. In addition, vertical or "over-the-top" ties may be installed in case of single-wide structures.

The vertical support for manufactured buildings usually is provided by piers, such as concrete masonry piers, prefabricated steel piers, or precast concrete jack stands located under the parallel joists of the main frame of the manufactured building, with the vertical supports being spaced longitudinally along the parallel joists at approximately eight feet from one another.

While much attention has been placed on protecting the building from movement due to lateral wind forces, little effort has been placed on protecting the building from movement due to longitudinal wind forces. However, these longitudinal wind forces must be accounted for in order to prevent the building from shifting off the piers during periods of high wind exposure.

Therefore, there is a need to provide a system which protects a manufactured building from horizontal movement along its length relative to the support piers due to longitudinal wind forces.

SUMMARY OF THE INVENTION

The present invention provides an apparatus and method for supporting a manufactured home having at least a pair of support joists for mounting horizontally on a pair of support piers and for supporting the manufactured home above a ground surface. Briefly described, in architecture, the support assembly comprises a pair of upright support piers including an upper end for supporting a support joist and a lower end positioned toward the ground surface. Further included is a support platform positioned beneath the lower end of the support pier and adjacent to the ground. A stabilization pad is positioned adjacent the lower end of the support pier and adjacent the support platform and disposed therebetween. The stabilization pad includes a first end opposing a second end and is configured to apply a clamping force. A lateral compression member extends from the first end of the stabilization pad and a link is anchored toward the second end of the stabilization pad. For stabilization, included is at least one tie strap, where the strap extends upwardly from the link, over the support joist and extends downwardly from the support joist to an anchor member.

DETAILED DESCRIPTION OF THE PREFERRED EMBODIMENTS

Figure 1:
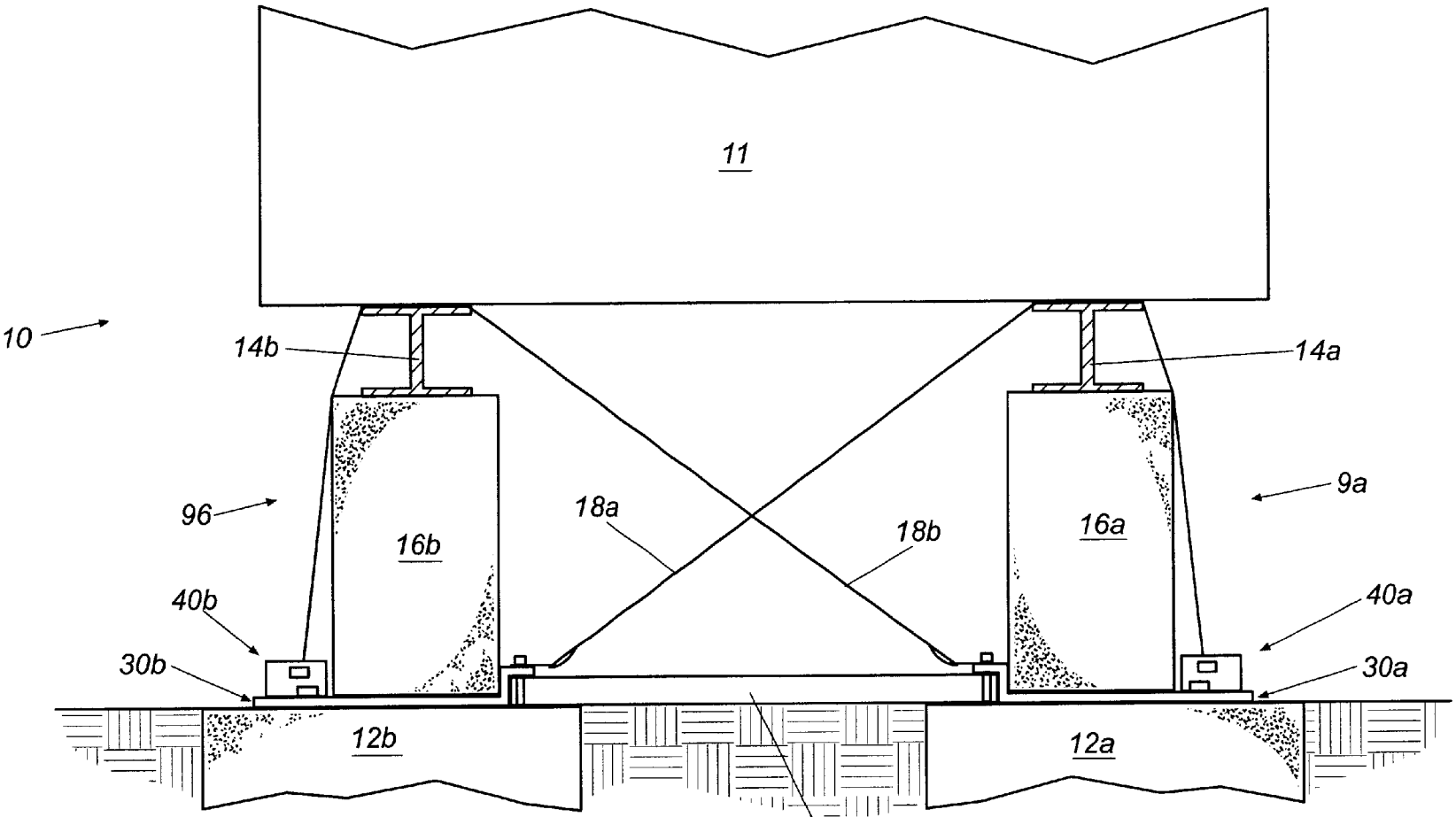
FIG. 1 is a side view of the support assembly system.

While the invention is susceptible to various modification and alternative forms, a specific embodiment thereof is shown by way of example in the drawings and will herein be described in detail. It should be understood, however, that there is no intent to limit the invention to the particular form disclosed, but on the contrary, the invention is to cover all modification, equivalents, and alternatives falling within the spirit and scope of the invention as defined by the claims.

Referring now in more detail to the drawings, in which like numerals indicate like parts throughout the several views, FIG. 1 illustrates a preferred embodiment of the support assembly 10 installed beneath a premanufactured building 11. The premanufactured building 11 includes a pair of parallel, horizontally oriented I-beam support joists

14*a* and 14*b* on the underside of the building 11. The I-beam support joists 14*a* and 14*b* extend the length of the building 11. The support assembly 10 includes a pair of side-by-side vertical support structures 9*a* and 9*b*, with each vertical support structure 9*a* and 9*b* being positioned on the ground surface 13 and beneath an I-beam joist 14*a* and 14*b* of the premanufactured building. Each vertical support structure 9*a* and 9*b* includes a support platform 12*a* and 12*b* which is mounted adjacent the ground surface, a stabilization pad 30*a* and 30*b* mounted on the support platform 12*a* and 12*b*, and an upright pier 16*a* and 16*b* mounted on the stabilization pad 30*a* and 30*b*. A lateral compression member 20 extends between stabilization pads 30*a* and 30*b* and a pair of tie straps 18*a* and 18*b* extend about the upper portions of the vertical support structures 9*a* and 9*b* and over their respective I-beam joists 14*a* and 14*b*. A longitudinal strut 60*a* (shown in FIG. 2) extends from the stabilization pads 30*a* and 30*b* to the joist 14*a* and 14*b* underneath which the longitudinal strut 60*a* originates.

Figure 2:
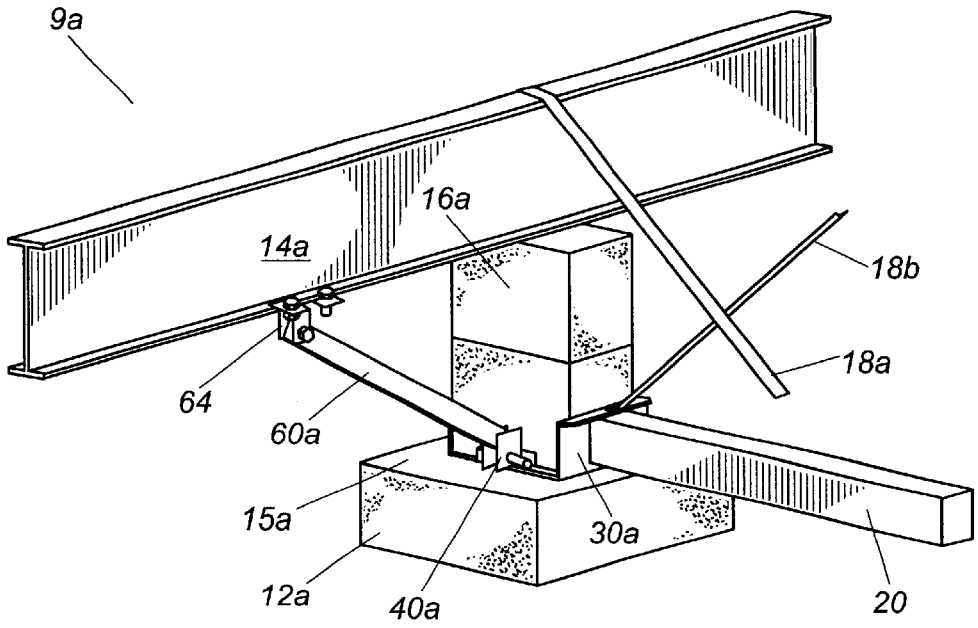
FIG. 2 is a perspective view of the support assembly system of FIG. 1 with a longitudinal link.
Figure 3:
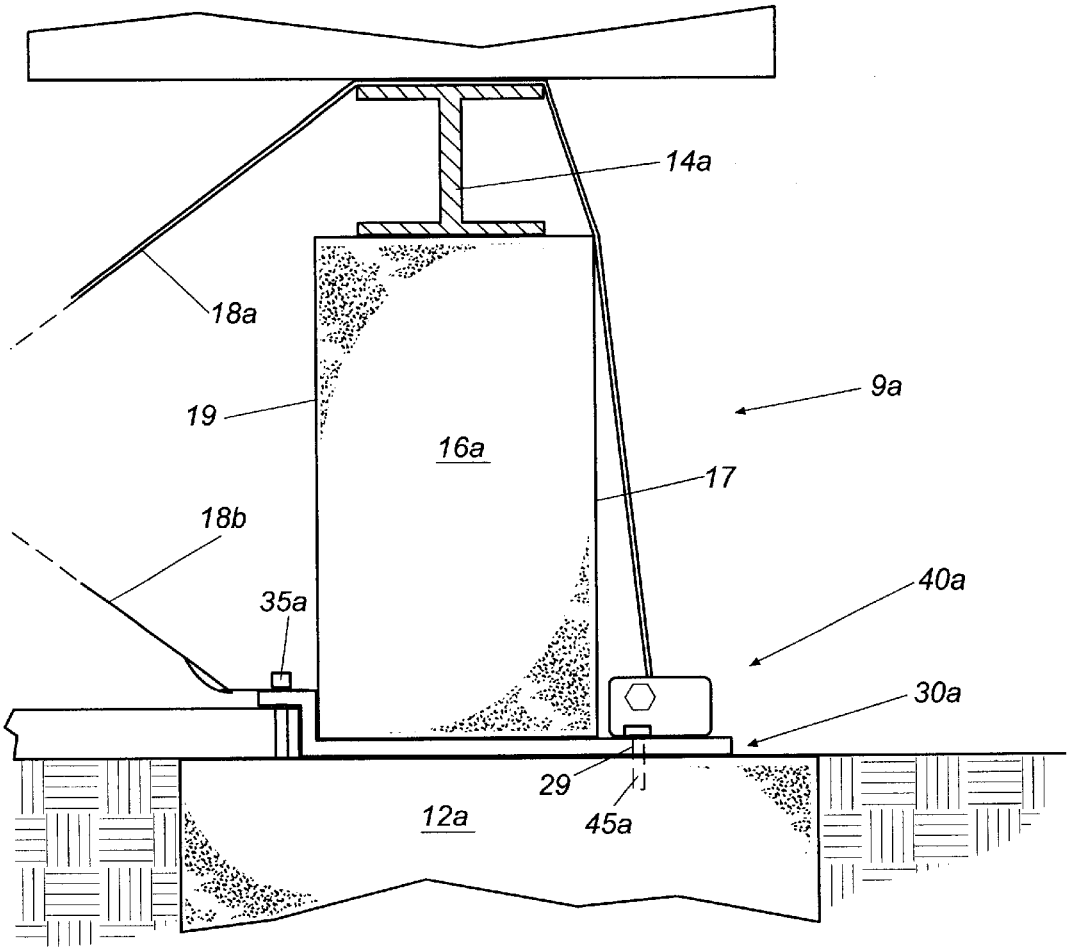
FIG. 3 is a close-up side view of one support pier and support joist of the support assembly system illustrated in FIG. 1.

FIGS. 2 and 3 illustrate a close-up view of the vertical support structure 9*a* which will be discussed herein in detail. It should be understood, however, that the vertical support structure 9*b* is similar in structure and method of use. Turning first to FIG. 2, the foundation pad 12*a* has a planar top surface 15*a*. The stabilization pad 30*a* is attached to the planar top surface 15*a* of the support platform 12*a* and the support pier 16*a* is positioned on top of the stabilization pad 30*a*, on a base portion 32 (shown in FIG. 4) of the stabilization pad 30*a*. The I-beam support joist 14*a* for the premanufactured building 11 is positioned on top of the support pier 16*a*. The support pier 16*a* includes an outside edge 17 and an inside edge 19, where the outside edge 17 is positioned away from the adjacent vertical support structure 9*b* and the inside edge 19 is positioned toward the adjacent vertical support structure 9*b*. At least one link 40*a* is positioned on the base portion 32 of the stabilization pad 30*a*, or formed as a portion thereof. A lateral compression member 20 extends from underneath a clamping lip 36 (shown in FIG. 4) of the stabilization pad 30*a* and is fixed thereto, to underneath a portion of the stabilization pad 30*b* as part of the vertical support structure 9*b*. (shown in FIG. 1). To provide resistance to longitudinal forces on the building 11, a longitudinal strut 60*a* is positioned extending from a portion of the stabilization pad 30*a* to the support joist 14*a* under which the stabilization pad 30*a* is positioned. The longitudinal strut 60*a* is fixed to the stabilization pad by a link 40*a*, (shown in FIG. 5 and discussed in further detail below) disposed on the stabilization pad 30*a* adjacent the outside edge 17 or the inside edge 19 of the support assembly 9*a*. The support assembly 9*a* further preferably includes tie straps 18*a* and 18*b* fixed to the stabilization pad 30*a* by an additional link 40*a*, disposed on the stabilization pad 30*a* opposite the clamping lip 36, and a strap connector 38, respectively, for resistance to lateral movement of the building.

The longitudinal strut 60*a* is preferably fixed to an underside portion of the support joist 14*a*. The longitudinal strut 60*a* can be fixed thereto by another link 40*a* attached to the support joist 14*a*, or by any other suitable means. The longitudinal strut 60*a* maintains compression forces and is preferably substantially rigid.

Turning next to FIG. 3, illustrated is a close up view of the vertical support structure 9*a* of the support assembly 10, and specifically shows the preferred configuration for attaching the tie straps 18*a* and 18*b* to the stabilization pad 30*a*. A tie strap 18*a* is positioned such as to extend from the link 40*a* upwardly to a top portion of the joist 14*a*, positioned atop the pier 16*a* to which the link 40*a* is adjacent, across the top of the joist 14*a*, and underneath the premanufactured building 11, then extends downwardly toward a portion of a stabilization pad 30*b* positioned beneath the adjacent support pier 16*b* (shown in FIG. 1). Although the stabilization system is disclosed herein as configured to provide resistance to both lateral and longitudinal forces, it should be understood that the system could be implemented with just the lateral resistance (tie straps 18*a* and 18*b*) in place or with just the longitudinal resistance (longitudinal strut 60*a*) in place.

Figure 4:
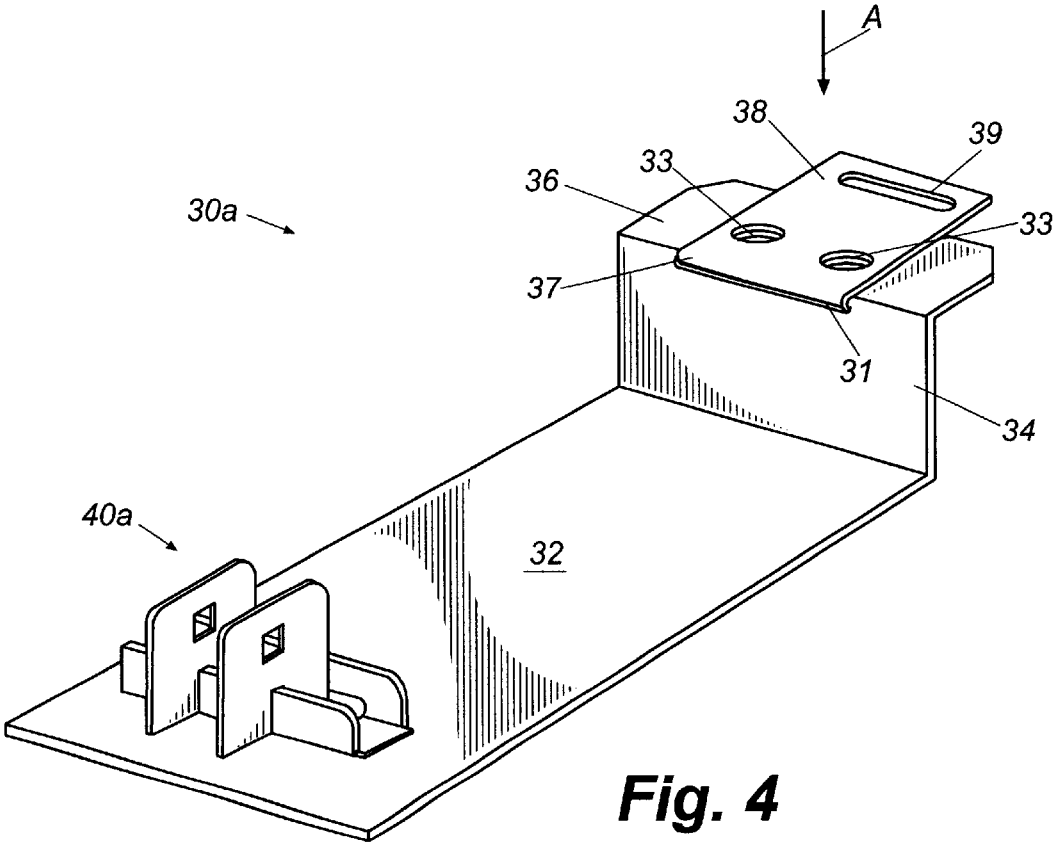
FIG. 4 is a close-up perspective view of the stabilization pad illustrated in FIGS. 2 and 3.

FIG. 4 illustrates a preferred embodiment of a stabilization pad 30*a*. The stabilization pad 30*a* comprises a base portion 32, a vertical rise 34, and a clamping lip 36. The base portion 32 may preferably have positioned on it, or formed as part of it, at least one link 40*a* adjacent a first end, and a clamping lip 36 being adjacent a second opposing end. The base portion 32 further preferably includes a pair of fixing apertures 29 each for receiving a fixing member 45*a* (FIG. 3). Each fixing member 45*a* preferably engages the base portion 32 of the stabilization pad 30*a* and the support platform 12*a* to fix the stabilization pad 30*a* in position on the support platform 12*a*. The base portion 32 of the stabilization pad 30a is preferably configured to receive a support pier 16*a*, as shown in FIG. 1. The vertical rise 34 extends substantially vertically from one edge of the base portion 32 of the stabilization pad 30*a*. The vertical rise 34 is arranged and configured to be positioned adjacent the inside edge 19 of a support pier 16*a* when the stabilization pad 30*a* is in use. The clamping lip 36 is substantially perpendicular to the vertical rise 34 and extends in a direction away from the base portion 32 of the stabilization pad 30*a* at an end of the vertical rise 34 opposite the end adjacent the base portion 32. The vertical rise 34 of the stabilization pad 30*a* preferably includes a substantially elongated slot 31 disposed therethrough and adjacent the intersection of the clamping lip 36 and the vertical rise 34. The strap connector 38 is arranged and configured to receive a portion of a tie strap 18*b* and preferably includes a portion 37 that effectively acts as a "hook" that can be inserted in the substantially elongated slot 31 of the vertical rise 34 for fixing the strap connector 38 to the stabilization pad 30*a*. The clamping lip 36 preferably includes the strap connector 38 disposed thereon (as described previously) or formed as a part thereof. The strap connector 38 preferably includes a strap connector aperture 39 for receiving a portion of a tie strap 18*b* extending from the top of the supportjoist 14*b* located opposite the pier 16*b* underneath which the stabilization pad 30*b* is located. The clamping lip 36 and preferably the strap connector 38 include a pair of clamping apertures 33 disposed therethrough for receiving a clamping member 35 preferably, but not limited to, a U-Bolt, for fixing the lateral compression member 20 (shown in FIG. 2) positioned underneath the clamping lip 36. It should be noted that the stabilization pad 30*b* is preferably similar in structure to that of stabilization pad 30*a* disclosed herein.

Figure 5:
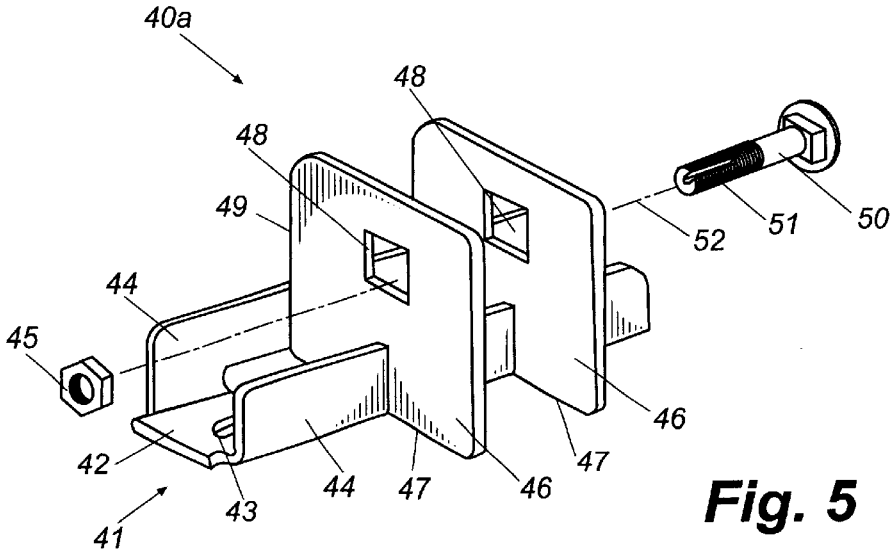
FIG. 5 is a close-up perspective view of the link illustrated in FIG. 2.

FIG. 5 illustrates a preferred embodiment of a 40*a*. The link 40*a*, formed to a predetermined length, includes a U-shaped channel support member 41 having a base portion 42 and a pair of side edges 44. Intermediate to the length of the U-shaped channel support member 41 and spaced apart are a pair of plates 46. Each plate 46 is preferably positioned such that a bottom edge 47 of the plate 46 is flush with the plane of the base portion 42, and such that a front edge 49 of the plate 46 is disposed flush with one of the side edges 44 of the U-shaped channel support member 41. Each plate 46 is aligned and arranged substantially parallel to the other. Each plate 46 includes at least one aperture 48. The apertures 48 are axially aligned with each other. The apertures 48 are arranged and configured to receive a fastener 50 therethrough. The fastener 50 can comprise a bolt or any suitable member for engaging the aperture 48 disposed in each plate 46 and an item disposed therebetween. The link 40*a* is preferably configured to fix the longitudinal strut 60*a* to the stabilization pad 30*a* or to fix and tension the tie strap 18*a* to the stabilization pad 30*a*. When used to fix the longitudinal strut 60*a* to the stabilizing pad 30*a*, the link 40*a* is preferably configured with a solid fastener 50, such as a bolt or the like. When the link 40*a* is used to fix and tension the tie strap 18*a* it is preferably configured with a fastener 50 having a longitudinal slot 51 disposed therein. The slot 51 of the fastener 50 is preferably arranged and configured to receive a portion of a tie strap 18*a*. It should be noted that the link 40*b* is preferably similar in structure to that of link 40*a* disclosed herein.

The base portion 42 of the U-shaped channel support member 41 preferably includes a pair of mounting apertures 43. The link 40*a* is preferably mounted on the stabilization pad 30*a* such that the mounting apertures 43 of the link 40*a* are aligned with the fixing apertures 29 of the stabilization pad 30*a*. The mounting apertures 43 are preferably arranged and configured to receive a mounting member 45*a*. When used to fix the longitudinal strut 60*a*, the link 40*a* is preferably oriented on the stabilization pad 30*a* such that the plane of each plate 46 is parallel to the plane of the vertical rise 34 of the stabilization pad 30*a* and adjacent the inside edge 19 or outside edge 17 of the pier 16*a*. When used to fix the tie strap 18*a*, the link 40*a* is preferably oriented on the stabilization pad 30*a* such that the plane of the plates 46 is substantially perpendicular to the plane of the vertical rise 34 of the stabilization pad 30*a* and toward an edge of the stabilization pad 30*a* opposing the vertical rise 34.

In a preferred method of use, the support assembly 10 is structurally arranged and configured as described above. The stabilization pad 30*a* preferably includes a pair of links 40*a* disposed on the base portion 32. A first link 40*a* is provided opposite the vertical rise 34 of the stabilization pad 30*a*, and a second link 40*a* is oriented substantially perpendicular to the first link 40*a* and toward an edge of the stabilization pad 30*a* on the base portion 32. A longitudinal strut 60*a* is fixed to the second of the links 40*a* using the fastener 50. The fastener 50 engages the aperture 48 of each plate 46 and a portion of the longitudinal strut 60*a*. The longitudinal strut 60*a* is fixed to a portion of the joist 14*a* by any suitable fixing means 64 and is in compression. A tie strap 18*b* is disposed through a strap connector aperture 39 disposed in the strap connector 38 of the stabilization pad 30*a*. The tie strap 18*b* is drawn upwardly towards the support joist 14*b* opposite the stabilization pad 30*a* to which the tie strap 18*b* originates, until it reaches the opposite support joist 14*b* and extends across the top of that support joist 14*b* and beneath the premanufactured home 11. The tie strap 18*b* is then drawn downwardly toward the link 40*b* disposed on the stabilization pad 30*b* underneath the support pier 16*b* supporting the joist 14*b* over which the tie strap 18*b* extends. The fastener 50, preferably having a slot 51 disposed therein, is disposed through one of the apertures 48 located in the plates 46 of the link 40*b*. The slot 51 disposed in the fastener 50 engages the tie strap 18*b* between the two plates 46. The fastener 50 is then disposed through the next plate 46 via the aperture 48. The fastener 50 is then fixed within the apertures 48 with a fixing member 45. The fastener 50 as engaged by the fixing member 45 is free to move about an axis 52. The fastener 50 can be rotated about the axis 52 thereby wrapping a portion of the tie strap 18*b* around a portion of the fastener 50 and producing an increasing tension on the tie strap 18*b*. This winding motion applied to the fastener 50 acts to tighten and secure the support assembly apparatus 10. It is preferred that a similar method is followed for further tightening and securing the support assembly apparatus 10 with tie strap 18*a*.

Many variations and modifications may be made to the above-described embodiment(s) of the invention without department substantially from the spirit and principles of the invention. All such modifications and variations are intended to be included herein within the scope of the present invention.

What is claimed is:

1. A support assembly for supporting a premanufactured building, the building including at least a first support joist and a second support joist, the support joists being horizontally oriented beneath the building, said support assembly comprising:

first and second side-by-side vertical support structures, each support structure adapted to be positioned on a ground surface, said first support structure adapted to be disposed beneath the first support joist of the building and said second support structure adapted to be disposed beneath the second support joist of the building, said vertical support structures adapted to be aligned with each other substantially perpendicularly to the length of the premanufactured building;

said first and second vertical support structures each including a support platform for resting adjacent a ground surface, a stabilization pad mounted on said support platform, and a pier mounted on said stabilization pad adapted for supporting a joist of a premanufactured home;

said stabilization pad including a base portion for supporting said pier, a vertical rise extending upwardly from said base portion, a clamping lip extending laterally from said vertical rise and away from said base portion;

a lateral compression member extending between and joined at its ends to said stabilization pads of said first and second vertical support structures at said vertical rise and said clamping lip and arranged to resist forces urging said vertical support structures toward each other;

first and second elongated tie straps each having opposed ends;

said first tie strap being connected at one of its ends to said stabilization pad of said second vertical support structure and extending laterally and upwardly toward said first vertical support structure for extending over said first joist and connected at its other end to said stabilization pad of said first vertical support structure;

said second tie strap being connected at one of its ends to said stabilization pad of said first vertical support structure and extending laterally and upwardly toward said second vertical support structure for extending over said first joist and connected at its other end to said stabilization pad of said second vertical support structure.

2. The support assembly of claim 1, further comprising:

a first longitudinal strut, said first longitudinal strut extending upwardly and laterally from said first vertical support structure and adapted to be connected to said first support joist.

3. The support assembly of claim 2, wherein said first longitudinal strut is substantially rigid.

4. The support assembly of claim 1, further comprising:

a second longitudinal strut, said second longitudinal strut extending upwardly and laterally from said second vertical support structure and adapted to be connected to said second support joist.

5. The support assembly of claim 4, wherein said second longitudinal strut is substantially rigid.

6. The support assembly of claim 1, wherein said stabilization pad further comprises:

a base portion;

a vertical rise, said vertical rise extending substantially perpendicularly from said base portion; and a clamping lip, said clamping lip extending substantially perpendicularly from said vertical rise opposite said base portion, said clamping lip disposed substantially parallel to said base portion and extending away from said base portion, said clamping lip disposed toward said clamping portion of said stabilization pad.

7. The support assembly of claim 6, wherein said stabilization pad further comprises:

a strap connector, said strap connector being fixed to said stabilization pad at a substantially elongated slot disposed through a portion of said vertical rise adjacent said clamping lip, said strap connector extending from said clamping lip substantially away from said pier under which the stabilization pad is positioned and substantially parallel to said clamping lip, wherein said strap connector is arranged and configured to receive a portion of a tie strap.

8. A support assembly for supporting a premanufactured building, the building including at least a first and a second support joist being horizontally oriented beneath the building, said support assembly comprising:

first and second side-by-side vertical support structures, each support structure positioned on a ground surface, said first support structure adapted to be disposed beneath the first support joist of the building and said second support structure adapted to be disposed beneath the second support joist of the building, said vertical support structures adapted to be aligned with each other substantially perpendicularly to the length of the premanufactured building;

said first and second vertical support structures each including a support platform for resting adjacent a ground surface, a stabilization pad mounted on said support platform, and a pier mounted on said stabilization pad adapted for supporting a joist of a premanufactured home;

said stabilization pad including a fixing aperture, said fixing aperture being disposed in said base portion of said stabilization pad, said fixing aperture arranged and configured to receive a fixing member for fixing said stabilization pad to a support platform upon which the stabilization pad is disposed;

a fixing member, said fixing member fixing said stabilization pad to a support platform;

a lateral compression member extending between and joined at its ends to said stabilization pads of said first and second vertical support structures and arranged to resist forces urging said vertical support structures toward each other;

first and second elongated tie straps each having opposed ends;

said first tie strap being connected at one of its ends to said stabilization pad of said second vertical support structure and extending laterally and upwardly toward said first vertical support structure for extending over said first joist and connected at its other end to said stabilization pad of said first vertical support structure; and said second tie strap being connected at one of its ends to said stabilization pad of said first vertical support structure and extending laterally and upwardly toward said second vertical support structure and extending over said first joist and connected at its other end to said stabilization pad of said second vertical support structure.

9. The support assembly of claim 1, wherein said stabilization pad further comprises:

a pair of clamping apertures, said clamping apertures being disposed on said clamping lip, said clamping apertures being arranged and configured to receive a portion of a clamping member for fixing a lateral compression member in position; and a clamping member, said clamping member fixing said lateral compression member.

10. A support assembly for supporting a manufactured building above a ground surface, the building including at least a first support joist and a second support joist said support joists extending parallel to each other and adapted to be horizontally mounted on piers, said support assembly including:

first and second pier assemblies, said first pier assembly adapted to be disposed beneath said first support joist, and said second pier assembly adapted to be disposed beneath said second support joist, said first pier assembly and said second pier assembly adapted to be aligned with each other substantially perpendicularly to said support joists;

each said pier assembly including an upright support pier with an upper end positioned for supporting a support joist and a lower end disposed toward a ground surface, a support platform positioned beneath the lower end of said support pier and adjacent the ground surface, and a stabilization pad positioned between the lower end of said support pier and said support platform, said stabilization pad having opposed first and second ends, a strap connector at said first end and a clamp at said second end;

a lateral compression member engaging and extending adjacent the ground surface from beneath and between said clamps of said stabilization pads of said first and second pier assemblies;

first and second tie straps, each said tie strap having a first end and a second end;

said first end of said first tie strap being connected to said strap connector of said stabilization pad of said second pier assembly and said first tie strap extending upwardly and laterally from said strap connector for extending over said first support joist and sloped downwardly from said first pier assembly and connected at its second end to said stabilization pad of said first pier assembly;

said first end of said second tie strap being connected to said strap connector of said stabilization pad of said first pier assembly, said second tie strap extending upwardly and laterally from said strap connector for extending over said second support joist and sloped downwardly from said second pier assembly and connected at its second end to said stabilization pad of said second pier assembly;

whereby the weight of each of said first and second pier assemblies and the first and second tie straps retard movement of the pier assemblies away from each other and the lateral compression member retards movement of the pier assemblies toward each other.

11. The support assembly of claim 10, wherein said support platform comprises concrete.

12. A support assembly of claim 1, further comprising:

said strap connector being fixed to said clamping lip of said stabilization pad, said strap connector extending from said clamping lip substantially away from the support pier under which the stabilization pad is positioned and substantially parallel to said clamping lip.

13. A support assembly for supporting a manufactured building above a ground surface, including at least first and second parallel support joists each adapted to be mounted horizontally on piers, said support assembly including:

first and second pier assemblies, said first pier assembly adapted to be disposed beneath a first support joist, and said second pier assembly adapted to be disposed beneath said second support joist, said first pier assembly and said second pier assembly adapted to be aligned with each other substantially perpendicularly to the lengths of the support joists;

each pier assembly including an upright support pier with an upper end positioned for supporting a support joist and a lower end disposed toward a ground surface, a support platform positioned beneath the lower end of said support pier and adjacent the ground surface, and a stabilization pad positioned between the lower end of said support pier and said support platform, and a fixing member, said fixing member connecting together said base portion of said stabilization pad and said support platform;

a lateral compression member engaging and extending between said stabilization pads of said first and second pier assemblies; and tie straps having opposed ends, said tie straps adapted to extend over a support joist of the building, said tie straps attached at their opposed ends to the stabilization pads of said pier assemblies.

14. The support assembly of claim 10, wherein said clamp comprises a U-bolt, wherein said clamp fixes a compression member to a stabilization pad.

15. The support assembly of claim 10, wherein said stabilization pad comprises steel.

16. The support assembly of claim 10, and further comprising a strap tension adjuster including:

a U-shaped channel support having a base and opposed parallel side walls, said side walls being substantially perpendicular to said base;

a mounting aperture disposed through said base of said channel support, said mounting aperture being arranged and configured to receive a fixing member, wherein said fixing member fixed said link to said stabilization platform;

a pair of parallel plates, said plates spaced from each other and oriented substantially perpendicular to said side edges and said base portion, said pair of plates disposed substantially parallel to each other, each of said plates having an aperture disposed therein, said apertures being axially aligned; and a winding member, said winding member being disposed through said apertures disposed in said plates, said winding member configured to receive said tie strap.

17. The support assembly of claim 10, wherein said lateral compression member is substantially rigid.

18. The support assembly of claim 10, further comprising;

a link disposed adjacent a side edge of said stabilization pad of each of said first and second vertical support structures; and a longitudinal strut extending from said longitudinal link upwardly to each of said first and second support joists supported by each of said first and second vertical support structures, respectively.

19. The support assembly of claim 18, wherein said longitudinal link comprises, a U-shaped channel support having a base and opposed parallel side walls, said side walls being substantially perpendicular to said base;

a mounting aperture disposed through said base of said channel support, said mounting aperture being arranged and configured to receive a fixing member, wherein said fixing member fixed said link to said stabilization platform;

a pair of parallel plates, said plates spaced from each other and oriented substantially perpendicular to said side edges and said base portion, said pair of plates disposed substantially parallel to each other, each of said plates having an aperture disposed therein, said apertures being axially aligned; and a fixing member, wherein said longitudinal link strut is received between said pair of parallel plates and said fixing member is disposed to pass through said aperture disposed in each plate and through said longitudinal link strut.

20. The support assembly of claim 19, wherein said longitudinal link strut is substantially rigid.

* * * * *